United States Patent [19]

Yutori et al.

[11] 4,406,713

[45] Sep. 27, 1983

[54] METHOD OF MAKING HIGH-STRENGTH, HIGH-TOUGHNESS STEEL WITH GOOD WORKABILITY

[75] Inventors: Toshiaki Yutori; Rikuo Ogawa, both of Kobe, Japan

[73] Assignee: Kabushiki Kaisha Kobe Seiko Sho, Kobe, Japan

[21] Appl. No.: 246,059

[22] Filed: Mar. 20, 1981

[51] Int. Cl.[3] ..... C21D 8/00

[52] U.S. Cl. ..... 148/12 B; 148/12 F; 148/12.4; 148/36

[58] Field of Search ..... 148/12 B, 12.4, 156, 148/12 F, 36

[56] References Cited

U.S. PATENT DOCUMENTS

| | | | |
|---|---|---|---|
| 3,939,015 | 2/1976 | Grange | 148/12B |
| 4,072,543 | 2/1978 | Coldren et al. | 148/12 F |
| 4,188,241 | 2/1980 | Watanabe et al. | 148/12 F |
| 4,284,438 | 8/1981 | Barwick et al. | 148/12 B |
| 4,325,751 | 4/1982 | Josefsson | 148/12.4 |

FOREIGN PATENT DOCUMENTS

| | | | |
|---|---|---|---|
| 54-114426 | 9/1979 | Japan | 148/12 F |
| 55-34659 | 3/1980 | Japan | 148/12 F |
| 55-44551 | 3/1980 | Japan | 148/12 F |
| 1001233 | 8/1965 | United Kingdom | 148/12 B |

*Primary Examiner*—Peter K. Skiff

*Attorney, Agent, or Firm*—Oblon, Fisher, Spivak, McClelland & Maier

[57] ABSTRACT

A high-strength, high-toughness steel with good workability is produced by working a steel containing 0.005–0.3% C and 0.3–2.5% Mn and optionally up to 1.5% Si, in the course of hot working thereof, at temperatures within the range of from the $Ar_3$ point to 930° C. or to 980° C. (for a steel containing Nb, V, Ti and/or Zr) at an area reduction rate of at least 30%, and, in the course of cooling, rapidly cooling the steel in the ferrite phase precipitation temperature range when the ferrite phase has occupied 5–65% or 5–60% (for a steel with Si and/or Nb, V, Ti and/or Zr) of the steel, whereby a two-phase structure comprising ferrite and martensite is produced.

16 Claims, 1 Drawing Figure

METHOD OF MAKING HIGH-STRENGTH, HIGH-TOUGHNESS STEEL WITH GOOD WORKABILITY

BACKGROUND OF THE INVENTION

1. Field of the Invention

This invention relates to a method for making a steel having high tensile strength and good toughness with excellent workability in cold working, the tensile strength being not less than 50 kg/mm$^2$.

2. Description of the Prior Art

High tensile steels with a tensile strength of 50–100 kg/mm$^2$ are widely used. For use in construction and shipbuilding, for instance, they are required to have good weldability. For those to be worked to specified dimensions followed by welding as necessary such as in the field of industrial machines or in the case of materials for making pipes or bolts, excellent cold workability and weldability are required. So far, in making high tensile steels of the nonheat treated type or the heat treated (quenched and tempered) type, large amounts of additive elements are used to enhance mechanical properties but inevitably lead to an increased carbon equivalent which is undesirable to weldability. Making high strength steels in this way has a substantial problem in that it is accompanied by an increase in yield ratio and a decrease in toughness and in ductility. Thus, such high strength steels are subject to cracking during cold working due to insufficiency in toughness and ductility or lead to inadequate shaping due to springback resulting from high yield ratios. In the case of nonheat treated high strength materials for bolts or high strength steels for cold forging, working tools have to bear an increased burden during cold working, such as bolt forming or other various kinds of cold forming, whereby the life of the tools is greatly shortened.

SUMMARY OF THE INVENTION

An object of the present invention is to provide a method of improving the strength of steel in a manner different from the prior art, which method overcomes the above problems. Another object is to provide a method of improving weldability of a steel by lowering the carbon equivalent to a great extent so as to attain the desired strength and at the same time realize a very low yield ratio and give the steel excellent toughness and cold weldability.

Thus, the invention provides a method of making a high strength steel with excellent workability which comprises working a steel containing 0.005–0.3% C (carbon) and 0.3–2.5% Mn (manganese), in the course of hot working thereof, at temperatures within the range of from the $Ar_3$ point to 930° C. at an area reduction rate of at least 30%, and, in the course of cooling, rapidly cooling the steel in the ferrite phase precipitation range when the ferrite phase has occupied 5–65% of the steel, whereby a two-phase structure comprising ferrite plus martensite is obtained.

BRIEF DESCRIPTION OF THE DRAWING

In the accompanying drawing.

DETAILED DESCRIPTION OF THE INVENTION

Figure 1:
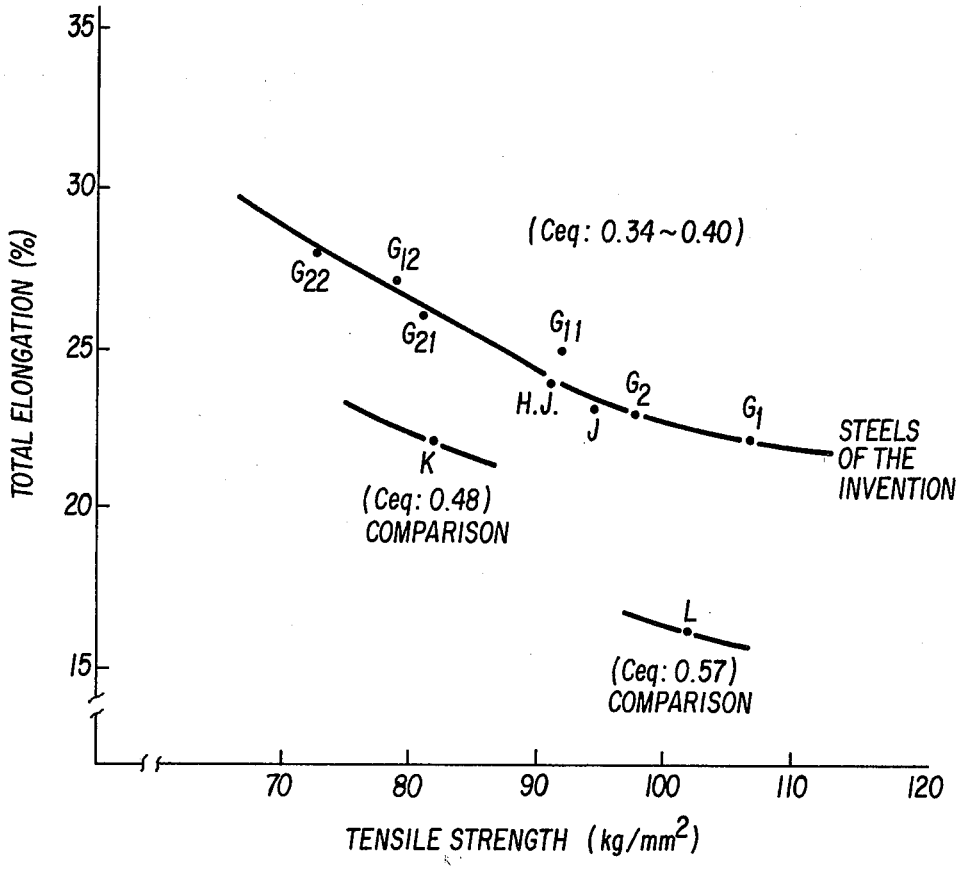
FIG. 1 shows the relation between the tensile strength and the total elongation for high tensile steels in accordance with the examples described hereinafter.

In accordance with the present invention, a steel of a specified composition is first subjected to hot working (e.g. hot rolling). In this hot working, the steel is worked at temperatures within the range of from the $Ar_3$ point to at most 930° C., in which the recrystallization of austenite is significantly retarded, at an area reduction rate of at least 30%. The working at said temperatures introduces a lot of strain into the austenite. The hardened austenite causes a shift of the ferrite phase precipitation temperature range in a usual CCT (continuous cooling information) diagram to the higher temperature and shorter time side. At temperatures above 930° C., austenite tends to recrystallize, and, at area reduction rates of less than 30%, no substantial effect of imposing strain on austenite is produced.

In the case of a steel with niobium (Nb), vanadium (V), titanium (Ti) and zirconium (Zr) each added alone or in combination, which are effective in inhibiting the recrystallization of austenite, it is desirable to effect austenitizing at temperatures of 1,000°–1,300° C., preferably 1,050°–1,200° C., so that formation of coarse austenite grains can be prevented and a solid solution of the carbide/nitride forming elements (Nb, V, Ti and Zr) can be made. In this case, too, the steel is hot worked at temperatures within the range of from the $Ar_3$ point to 980° C. at the highest, in which the recrystallization of austenite is significantly retarded, at an area reduction rate of at least 30%. The working at said temperatures introduces a lot of strain into the austenite. The hardened austenite causes a shift of the ferrite phase precipitation temperature range in a usual CCT diagram to the higher temperature and shorter time side. At temperatures exceeding 980° C., austenite tends to recrystallize, and, at area reduction rates of less than 30%, no substantial effect of giving strain to austenite is observable.

After the working, in the course of cooling within the ferrite phase precipitation temperature range, carbon is concentrated in the untransformed austenite phase as the precipitation of the ferrite phase proceeds. After the ferrite phase has occupied 5–65% of the steel, the steel is quenched so that the untransformed austenite with a high carbon concentration is cooled rapidly below Ms (martensite starting) temperature and there can be obtained a two-phase structure comprising fine grains of ferrite and martensite with a high carbon concentration. The precipitate ferrite grains from hardened austenite are fine and favorable to ductility and toughness, whereas the martensite has a very high strength due to concentration of the carbon and the martensite from hardened austenite is highly tough. In the case of the prior art ferrite-martensite two-phase steels made by heating in the (gamma+alpha) two-phase range, the ferrite phase can hardly be made highly tough by making ferrite grains finer and moreover the martensite phase is low in toughness.

The ferrite-martensite two-phase-structure steels of the present invention are high in tensilte strength, low in yield ratio, and excellent in ductility and in toughness, owing to the fact that both the soft ferrite phase and the hard martensite phase are highly ductile and tough.

The amount of ferrite formed in the ferrite precipitation range during the cooling before quenching is 5–65%. When the ferrite amount is less than 5%, the effects of the ferrite-martensite two-phase structure are insufficient and very low yield ratios cannot be attained. When the ferrite amount is 70% or more, the steel strength is increased very little and bainite formation tends to occur on rapid cooling. Moreover, with the increasing ferrite phase precipitation, the carbon concentration in the untransformed austenite becomes significant and consequently high carbon martensite is formed on rapid cooling. As a result, the hard phase is inferior in ductility and toughness, hence the product steel is inferior in ductility and toughness. Therefore, it is desirable that the carbon concentration in the untransformed austenite is 0.5–0.6% or less, and it is desirable to carry out the rapid cooling after precipitation of ferrite in an amount of 5–60%. While martensite is formed from the untransformed austenite on rapid cooling after 5–60% ferrite precipitation, precipitation of some quantity (about 10–20% or less) of ferrite may still be observable in the case of low carbon steels or depending on the cooling rate. These ferrite grains are, as above mentioned, fine and favorable to ductility and toughness.

The reasons for the limitation on the steel composition in the practice of the present invention are as follows. As for carbon preparation of a melt with a carbon content of less than 0.005% is expensive and such a carbon content is little effective in increasing the strength. Presence of carbon in amounts exceeding 0.3% deteriorates the toughness. Therefore, the upper limit is 0.3%. However, when especially good weldability is required, the carbon content should preferably be 0.2% of less.

Manganese is necessary to give the steel toughness. A level of less than 0.3% is inadequate with respect to such effect. At a content exceeding 2.5%, the effect is saturated and moreover bainite tends to be formed.

Silicon is very effective in building up an increased strength through its solid solution reinforcing action. At contents exceeding 1.5%, however, problems tend to arise with respect to scale formation on the steel surface, surface decarburization, weldability, etc. For uses in which excellent cold toughness is required, a silicon content of 1.0% or less is preferred. When especially good workability is required or when extreme working is conducted, the content should preferably be 0.5% or less.

The elements Nb, V, Ti and Zr have an effect of broadening the temperature range within which the recrystallization of austenite is retarded, and thereby enhance the effect of invention. However, at levels exceeding 0.1% for Nb, 0.15% for V, 0.3% for Ti and 0.3% for Zr, their effects are saturated. As for each of Nb and V, a preferred concentration is 0.5% or less.

Furthermore, the steels of the invention may contain not more than 1.0% each of Cr, Mo and Cu, not more than 1.5% of Ni, not more than 0.1% of Al, not more than 0.2% of P, not more than 0.02% of Ce and not more than 0.003% of Ca, each alone or in combination.

To obtain good weldability in accordance with the invention, it is desirable that the carbon equivalent ($=C+Si/24+Mn/6+Ni/40+Cr/5+Mo/4+V/14$) is 0.40% or less.

The ferrite-martensite steels of the invention as cooled have a very favorable balance between strength and ductility. For example, (tensile strength in $kg/mm^2$)$\times$(total elongation in %)$=1{,}700$ or more can be obtained. Under favorable conditions, the product can easily reach 1,900, and, under best conditions, 2,100 or more.

The following examples, including comparative examples, further illustrate the present invention. Examples 1–3 are for steels without Nb, V, Ti or Zr added, while Examples 4–6 are for steels with the elements Nb and/or V added.

EXAMPLE 1

The chemical compositions of the materials used are shown in Table 1. Material A was subjected to the method of the present invention and material B was for comparison.

TABLE 1

| | Chemical Composition (wt %) | | | | | | | |
|---|---|---|---|---|---|---|---|---|
| Material | C | Mn | Si | P | S | Cr | Al | C equivalent* |
| A | 0.15 | 1.32 | 0.42 | 0.016 | 0.007 | 0.02 | 0.03 | 0.39 |
| B | 0.16 | 1.21 | 0.22 | 0.014 | 0.006 | 0.02 | 0.03 | 0.38 |

*C equivalent $= C + \frac{Si}{24} + \frac{Mn}{6} + \frac{Ni}{40} + \frac{Cr}{5} + \frac{Mo}{4} + \frac{V}{14}$ After heating to 1,000° C., material A was subjected to rolling, which was completed at a finishing temperature of 780° C. The reduction of area in the temperature range from 930° C. to 780° C. was 68%, and the total reduction of area was 83%. After completion of the rolling, the material was air cooled to 740° C., and then water cooled. The rolling of material B was commenced at 1,100° C. and completed at a finishing temperature of 860° C. The reduction of area from 930° C. was 50%, and the total reduction was 83%. The material was then air cooled. Material B was not quenched, hence served as a comparative example. The mechanical properties and structures of these steels A and B are shown in Table 2. As shown by the data in Table 2, a sharp increase in the strength can be achieved in accordance with the invention without any impairment in ductility. The yield ratio was much lower and the workability higher as compared with the comparative example.

TABLE 2

| | | Mechanical Properties and Structure | | | | | |
|---|---|---|---|---|---|---|---|
| | Steel | 0.2% Yield point $kg/mm^2$ | Tensile strength $kg/mm^2$ | Yield ratio % | Total elongation % | Reduction of area % | Structure |
| Invention | A | 49.5 | 75.0 | 66 | 26.9 | 58 | 58% Ferrite + 42% martensite |
| For comparison | B | 43.4 | 54.7 | 79 | 28.3 | 64 | Ferrite + pearlite |

EXAMPLE 2

The chemical compositions of the materials used are shown in Table 3. Material C was subjected to the method of the invention to give a steel for use in cold forging bolts and so on, while material D gave a conventional steel for cold forging.

TABLE 3

| Material | Chemical Composition (wt %) C | Mn | Si | P | S | Al |
|---|---|---|---|---|---|---|
| C | 0.06 | 1.79 | 0.09 | 0.017 | 0.013 | 0.04 |
| D | 0.25 | 1.56 | 0.24 | 0.022 | 0.024 | 0.03 |

The rolling of material C was commenced at 1,000° C. and completed at a finishing temperature of 830° C. to give a wire rod with a diameter of 13.5 mm. The reduction of area from 930° C. was 63%. After completion of the rolling, the material was air cooled to 800° C. and then water cooled. The steel obtained (hereinafter called steel $C_1$) was drawn by 18%, and the resulting steel (hereinafter called steel $C_2$) was further subjected to bluing at 300° C. for 2 minutes (the blued steel hereinafter called steel $C_3$). Material D was heated to 1,150° C. and subjected to rolling, which was completed at 950° C. The material was then air cooled (steel $D_1$) and then subjected to bluing at 300° C. for 2 minutes. The mechanical properties and structure of these steels are shown in Table 4. The data in Table 4 indicate that the steel (rolled material) produced by the method of the invention has a very low yield ratio value, as compared with the steels for comparison, imposes a light burden on working tools during cold working such as drawing or bolt formation, has high strength values, and is highly ductile and tough. Blue heating can remarkably increase the yield ratio of the steel of the invention. Thus, the steel is very suitable as a material for making bolts.

TABLE 4

| | Steel | Mechanical Properties and Structure 0.2% Yield point kg/mm² | Tensile strength kg/mm² | Yield ratio % | Total elongation % | Reduction of area % | Structure |
|---|---|---|---|---|---|---|---|
| Invention | $C_1$ | 47.8 | 83.5 | 57 | 27.6 | 79 | 31% Ferrite + 69% martensite |
| | $C_2$ | 75.8 | 106.9 | 70 | 15.6 | 75 | |
| | $C_3$ | 106.1 | 108.2 | 98 | 16.4 | 76 | |
| For comparison | $C_1$ | 44.8 | 61.7 | 73 | 35.8 | 75 | Ferrite + pearlite |
| | $C_2$ | 66.4 | 78.0 | 85 | 17.7 | 72 | |
| | $C_3$ | 74.4 | 80.2 | 93 | 17.4 | 70 | |

EXAMPLE 3

The chemical compositions of the materials used are shown in Table 5. Material E was subjected to the method of the invention to give a steel wire or rod for prestressed concrete (PC), while material F was used to make a conventional steel wire for PC.

TABLE 5

| Material | Chemical Composition C | Mn | Si | P | S | Al |
|---|---|---|---|---|---|---|
| E | 0.18 | 1.26 | 0.22 | 0.016 | 0.005 | 0.03 |
| F | 0.72 | 0.79 | 0.23 | 0.021 | 0.009 | 0.03 |

After heating to 1,000° C., material E was subjected to rolling and rolled into a wire rod with a diameter of 13.5 mm at a finishing temperature of 820° C. The reduction of area from 930° C. was 63%. After completion of the rolling, the material was air cooled to 780° C. and then water cooled (steel $E_1$). The steel was subjected to 2% stretching and further to bluing at 300° C. for 2 minutes (steel $E_2$). On the other hand, material F was hot rolled, patented in molten lead, and further subjected to 14% drawing, 2% stretching and bluing at 300° C. for 2 minutes. The mechanical properties and structures of these steels are shown in Table 6. The data in Table 6 indicate that the steel of the invention has a high strength and a low yield ratio and in excellent in workability and that the yield ratio can significantly be increased by stretching and bluing. The steel of the invention is therefore very suited as a material for making PC wires and rods.

TABLE 6

| | Steel | Mechanical Properties and Structure 0.2% Yield point kg/mm² | Tensile strength kg/mm² | Yield ratio % | Total elongation % | Reduction of area % | Structure |
|---|---|---|---|---|---|---|---|
| Invention | $E_1$ | 51.3 | 108.0 | 49 | 26.1 | 65 | 23% Ferrite + 77% martensite |
| | $E_2$ | 107.7 | 111.3 | 97 | 21.3 | 73 | |
| For comparison | F | 110.0 | 119.1 | 92 | 9.0 | 35 | Pearlite |

EXAMPLE 4

The chemical compositions of the materials used are shown in Table 7. Materials G to J were subjected to the method of the invention. Steel K was an as-rolled high-tensile steel of the 80 kg/mm² class, and steel L was a quenched and tempered high-tensile steel of the 100 kg/mm² class.

TABLE 7

| Material | Chemical Composition (wt %) C | Mn | Si | Ni | Cr | Mo | V | Nb | C equivalent* |
|---|---|---|---|---|---|---|---|---|---|
| G | 0.11 | 1.26 | 0.22 | 0.01 | 0.01 | 0.01 | 0.04 | 0.04 | 0.34 |
| H | 0.10 | 1.25 | 0.26 | 0.01 | 0.31 | 0.01 | 0.05 | 0.04 | 0.39 |
| I | 0.10 | 1.38 | 0.26 | 0.01 | 0.01 | 0.10 | 0.05 | 0.04 | 0.37 |
| J | 0.05 | 1.59 | 0.11 | 0.22 | 0.01 | 0.29 | 0.01 | 0.06 | 0.40 |

TABLE 7-continued

| Material | Chemical Composition (wt %) C | Mn | Si | Ni | Cr | Mo | V | Nb | C equivalent* |
|---|---|---|---|---|---|---|---|---|---|
| K | 0.12 | 1.86 | 0.36 | 0.02 | 0.02 | 0.10 | 0.02 | 0.04 | 0.48 |
| L | 0.13 | 1.28 | 0.31 | 0.47 | 0.47 | 0.42 | 0.06 | 0.001 | 0.57 |

*C equivalent $= C + \frac{Si}{24} + \frac{Mn}{6} + \frac{Ni}{40} + \frac{Cr}{5} + \frac{Mo}{4} + \frac{V}{14}$ Materials G–J were heated to an austenitizing temperature of 1,150° C., and subjected to controlled rolling at an area reduction from 980° C. of 70% and a total area reduction of 85%. The finishing temperature was 830° C. Material G, after rolling, was air cooled for 44 seconds and then water cooled from 770° C. (steel $G_1$) or air cooled to 720° C. over 110 seconds and then water cooled (steel $G_2$). The ferrite fractions of steel $G_1$ and steel $G_2$ were 18% and 58%, respectively. Furthermore, steels $G_1$ and $G_2$ were tempered at 400° C. (steel $G_{11}$ and steel $G_{21}$, respectively) or at 600° C. (steel $G_{12}$ and steel $G_{22}$, respectively). Materials H–J, after rolling, were air cooled to 720° C. and then water cooled. The ferrite fraction was 59% for steel H, 55% for steel I, and 33% for steel J. Comparative steel K was obtained by hot rolling alone and had a bainite structure, whereas comparative steel L was obtained by hot rolling followed by quench hardening and tempering and had a tempered martensite structure. The mechanical properties and other data for these steels are shown in Table 8.

TABLE 8

| Steel | | Mechanical Properties: 0.2% Yield point (kg/mm²) | Tensile strength (kg/mm²) | Yield ratio (%) | Uniform elongation (%) | Total elongation (%) | vTrs (°C.) | vEs (kg · m) | Remarks: Plate thickness (%) | Heat treatment | Structure |
|---|---|---|---|---|---|---|---|---|---|---|---|
| Invention | | | | | | | | | | | |
| G | $G_1$ | 64 | 107 | 60 | 15 | 22 | −114 | 13 | 16 | Water cooling at 770° C. | 18% Ferrite 82% martensite |
| | $G_2$ | 57 | 98 | 58 | 16 | 23 | −91 | 12 | " | Water cooling at 720° C. | 58% Ferrite 42% martensite |
| | $G_{11}$ | 66 | 92 | 73 | — | 25 | — | — | " | Water cooling at 770° C.; tempering at 400° C. | — |
| | $G_{21}$ | 61 | 81 | 76 | — | 26 | — | — | " | Water cooling at 720° C.; tempering at 400° C. | — |
| | $G_{12}$ | 65 | 79 | 82 | — | 27 | — | — | " | Water cooling at 770° C.; tempering at 600° C. | — |
| | $G_{22}$ | 58 | 73 | 79 | — | 28 | — | — | " | Water cooling at 720° C.; tempering at 600° C. | — |
| H | | 63 | 92 | 68 | 15 | 24 | >−140 | 10 | " | Water cooling at 720° C. | 59% Ferrite 41% martensite |
| I | | 59 | 92 | 66 | 15 | 24 | −133 | 11 | " | Water cooling at 720° C. | 55% Ferrite 45% martensite |
| J | | 68 | 95 | 73 | 14 | 23 | >−140 | 19 | " | Water cooling at 720° C. | 33% Ferrite 67% martensite |
| For comparison | | | | | | | | | | | |
| K | | 73 | 82 | 89 | — | 22 | −97* | 6* | 4.5 | As rolled | Bainite |
| L | | 98 | 102 | 96 | — | 16 | −42 | 15 | 20 | Q-T treatment | Tempered martensite |

Notes:
JIS No. 13 4-mm thick tension test pieces were used.
JIS No. 4 full-sized Charpy test pieces were used (*: ⅓ in size).

As can be seen from the data in Table 8, the steels produced by the method of the present invention have much lower C equivalent values as compared with the conventional high-tensile steels of the 80–100 kg/mm² classes. The quenched steels of the invention show tensile strength values of 90–100 kg/mm², yield ratios of about 70% or below, elongations of 22% or more, and, characteristically, increased uniform elongations. The fracture transition temperature is lower than −90° C. and is therefore satisfactory. Tempering causes a decrease in tensile strength but retains the yield strength at nearly a constant level, whereby the yield ratio is increased. However, when compared with the comparative steels, the yield ratio is still lower. FIG. 1 illustrates the balance between the strength and the elongation. When compared at the same strength level, the steels of the invention have lower C equivalent values and are superior in ductility.

EXAMPLE 5

The chemical compositions of the materials used are shown in Table 9. Material M was worked by the method of the invention to give an adequate steel for use in cold forging to make bolts etc. Material N was used to produce a comparative steel.

TABLE 9

| Material | Chemical Composition (wt %) C | Mn | Si | P | S | Nb | Al |
|---|---|---|---|---|---|---|---|
| M | 0.08 | 1.64 | 0.10 | 0.015 | 0.010 | 0.049 | 0.03 |
| N | 0.25 | 1.56 | 0.24 | 0.022 | 0.024 | — | 0.03 |

Material M was heated to an austenitizing temperature of 1,150° C. and subjected to controlled rolling at an area reduction from 980° C. of 64% and a total area reduction of 88% to give a wire rod with a diameter of 13.5 mm. The finishing temperature was 830° C. Material M, after rolling, was water cooled at and from 800° C. (steel $M_1$) or at and from 740° C. (Steel $M_2$).

On the other hand, material N was heated to an austenitizing temperature of 1,150° C. and subjected to rolling. After completion of the rolling at a finishing temperature of 950° C., the material was allowed to cool. These steels, $M_1$, $M_2$ and N, were subjected to 18% drawing (steels $M_{11}$,$M_{21}$ and $N_1$) and further to heat treatment at 300° C. for 2 minutes (steels $M_{12}$, $M_{22}$ and $N_2$). The mechanical properties of these steels are shown in Table 10.

TABLE 10

| | Steel | 0.2% Yield point kg/mm² | Tensile strength kg/mm² | Mechanical Properties: Yield ratio % | Total elongation % | Reduction of area % | Structure |
|---|---|---|---|---|---|---|---|
| Invention | $M_1$ | 46.0 | 87.7 | 52 | 27.7 | 76 | 26% Ferrite + 74% martensite |
| | $M_2$ | 40.7 | 95.4 | 43 | 26.4 | 70 | 42% Ferrite + 58% martensite |
| | $M_{11}$ | 78.3 | 110.8 | 71 | 15.0 | 74 | |
| | $M_{12}$ | 76.8 | 119.0 | 65 | 14.7 | 69 | |
| | $M_{21}$ | 115.5 | 117.6 | 98 | 16.8 | 75 | |
| | $M_{22}$ | 120.3 | 123.9 | 97 | 14.9 | 71 | |
| For comparison | $N_1$ | 44.8 | 61.7 | 73 | 35.8 | 75 | Ferrite + pearlite |
| | $N_{11}$ | 66.4 | 78.0 | 74 | 37.6 | 75 | |
| | $N_{12}$ | 74.4 | 80.2 | 93 | 17.4 | 70 | |

As can be seen from Table 10, the rolled steel materials produced by the method of the present invention are very low in yield ratio as compared with the comparative examples, lay only a slight load on working tools during cold working such as drawing, and are high in strength. Therefore, they are suited as nonrefined materials for making bolts.

EXAMPLE 6

The chemical compositions of the materials used are shown in Table 11. Material O was subjected to the method of the invention to produce a high strength steel wire such as a steel wire for PC. Material P was a high carbon wire steel.

TABLE 11

| Material | C | Chemical Compositions of Materials Used (wt %): Mn | Si | P | S | Cr | Nb |
|---|---|---|---|---|---|---|---|
| O | 0.18 | 1.42 | 0.22 | 0.009 | 0.008 | 0.01 | 0.05 |
| P | 0.72 | 0.79 | 0.23 | 0.017 | 0.014 | 0.03 | — |

Material O was heated to an austenitizing temperature of 1,150° C. and subjected to controlled rolling at an area reduction from 980° C. of 64% and a total area reduction of 88%, to give a wire rod with a diameter of 13.5 mm. The finishing temperature was 830° C. After the rolling, steel O was water cooled at and from 800° C., 770° C. or 740° C. (steel $O_1$, $O_2$ or $O_3$). These steels $O_1$, $O_2$ and $O_3$ were subjected to 2% stretch treatment and heat treatment at 300° C. for 2 minutes (steels $O_{11}$, $O_{21}$ and $O_{31}$, respectively). Steel $O_2$ was further subjected to 30% drawing and heat treatment at 270° C. for 2 minutes (steel $O_{22}$). On the other hand, steel P was rolled in a conventional manner, then subjected to patenting in molten lead, further to 15% drawing and lastly to heat treatment at 430° C. for 3 minutes. The mechanical properties of these steels are shown in Table 12.

TABLE 12

| | Steel | 0.2% Yield point kg/mm² | Mechanical Properties: Tensile strength kg/mm² | Yield ratio % | Total elongation % | Reduction of area % | |
|---|---|---|---|---|---|---|---|
| Invention | $O_1$ | 56.6 | 116.1 | 49 | 19.7 | 52 | 9% Ferrite + 91% martensite |
| | $O_2$ | 42.8 | 124.1 | 34 | 15.9 | 48 | 14% Ferrite + 86% martensite |
| | $O_3$ | 49.8 | 116.2 | 43 | 19.2 | 51 | 33% Ferrite + 67% martensite |
| | $O_{11}$ | 106.9 | 118.6 | 90 | 16.4 | 60 | |
| | $O_{12}$ | 112.1 | 122.3 | 92 | 14.2 | 58 | |
| | $O_{31}$ | 107.3 | 117.5 | 91 | 17.1 | 58 | |
| | $O_{22}$ | 170.7 | 172.3 | 99 | — | 52 | |
| For comparison | P | 111.0 | 123.0 | 91 | 8.7 | 23 | Pearlite |

As can be seen in Table 12, the rolled steel materials produced by the method of the present invention are high in strength and low in yield ratio and therefore easily workable. Moreover, heat treatment can give them a yield ratio of 0.9 or above. Thus, they are suitable as materials for making wires and rods for PC.

What is claimed is:

1. A method for making a high-strength, high-toughness steel with good workability which comprises working a steel containing 0.005–0.3% C and 0.3–2.5% Mn, in the course of hot working thereof, at temperatures within the range of from the $Ar_3$ point to 930° C. at an area reduction rate of at least 30%, and, in the course of cooling, rapidly cooling the steel in the ferrite phase precipitation temperature range when the ferrite phase has occupied 5–65% of the steel whereby a two-phase structure comprising ferrite and martensite is produced.

2. The method of claim 1, wherein the steel further contains up to 1.5% Si and the rapid cooling is carried out when the ferrite phase has occupied 5–60% of the steel.

3. The method of claim 2, wherein the steel contains 0.005–0.2%, C, 0.3–2.5% Mn and up to 1.5% Si.

4. The method of claim 2, wherein the steel contains 0.005–0.2% C, 0.3–2.5% Mn and up to 1.0% Si.

5. A method of making a high-strength, high-toughness steel with good workability which comprises working a steel containing 0.005–0.3% C, 0.3–2.5% Mn and at least one element of the group consisting of Nb, V, Ti and Zr in amounts of up to 0.1%, up to 0.15%, up to 0.3% and up to 0.3%, respectively, in the course of hot working thereof following heating to 1,000°–1,300° C., at temperatures within the range of from the $Ar_3$ point to 980° C. at an area reduction rate of at least 30%, and, in the course of cooling, quenching the steel in the ferrite phase precipitation temperature range when the ferrite phase has occupied 5–65% of the steel, whereby a two-phase structure comprising ferrite and martensite is produced.

6. The method of claim 5, wherein the steel further contains up to 1.5% Si and the quenching is carried out when the ferrite phase has occupied 5–60% of the steel.

7. The method of claim 6, wherein the steel contains 0.005–0.2% C, 0.3–2.5% Mn, up to 1.0% Si and at least one element of the group consisting of Nb, V, Ti and Zr in amounts of up to 0.1%, up to 0.15%, up to 0.3% and up to 0.3%, respectively.

8. The method of any one of claims 1–7 wherein said steel, after hot working, is air cooled in the ferrite phase precipitation temperature range until the ferrite phase occupies 5–65% of the steel, then cooled rapidly, whereby the remainder of the steel is converted into a phase comprised predominantly of martensite.

9. The process of claim 1 wherein said rapid cooling is carried out to a temperature below the $M_s$ temperature.

10. The process of claim 1 wherein said high strength steel has a tensile strength of at least 70 kg/mm$^2$.

11. The process of claim 1 wherein said high strength steel has a tensile strength of at least 70 kg/mm$^2$ and a value of (tensile strength in kg/mm$^2$ × % elongation) of at least 1700.

12. A steel produced by the process of claim 1.

13. A steel produced by the process of claim 5.

14. A steel produced by the process of claim 1 wherein said rapid cooling is carried out to a temperature below the $M_s$ temperature.

15. A steel produced by the process of claim 1 having a tensile strength of at least 70 kg/mm$^2$.

16. A steel produced by the process of claim 1 having a tensile strength of at least 70 kg/mm$^2$ and a value of (tensile strength in kg/mm$^2$ × % elongation) of at least 1700.

* * * * *

UNITED STATES PATENT AND TRADEMARK OFFICE

CERTIFICATE OF CORRECTION

PATENT NO. : 4,406,713

DATED : September 27, 1983

INVENTOR(S) : YUTORI ET AL

It is certified that error appears in the above—identified patent and that said Letters Patent is hereby corrected as shown below:

Claims 1 and 5, line 2, after "steel" insert --having a value of (tensile strength in $kg/mm^2$) x (% elongation) of at least 1700--.

Signed and Sealed this

*Ninth* Day of *October 1984*

[SEAL]

*Attest:*

GERALD J. MOSSINGHOFF

*Attesting Officer*

*Commissioner of Patents and Trademarks*